US007854323B2

(12) United States Patent
Weissbrod

(10) Patent No.: US 7,854,323 B2
(45) Date of Patent: Dec. 21, 2010

(54) INSERT FOR CONTAINER PACKAGING

(75) Inventor: Paul A. Weissbrod, South Euclid, OH (US)

(73) Assignee: Lincoln Global, Inc., City of Industry, CA (US)

( * ) Notice: Subject to any disclaimer, the term of this patent is extended or adjusted under 35 U.S.C. 154(b) by 0 days.

(21) Appl. No.: 12/435,068

(22) Filed: May 4, 2009

(65) Prior Publication Data

US 2009/0205290 A1 Aug. 20, 2009

Related U.S. Application Data

(62) Division of application No. 11/967,669, filed on Dec. 31, 2007, now abandoned.

(51) Int. Cl.
*B65D 85/26* (2006.01)

(52) U.S. Cl. ..... 206/443; 206/591; 206/814; 428/36.91; 53/527

(58) Field of Classification Search ..... 428/34.1, 428/98, 371; 206/584, 814, 443; 493/967
See application file for complete search history.

(56) References Cited

U.S. PATENT DOCUMENTS 2,851,157 A * 9/1958 Christman ..... 206/365
3,176,504 A 4/1965 Shapiro
3,887,077 A 6/1975 Frey
4,724,974 A * 2/1988 Marqua et al. ..... 217/64
5,263,587 A 11/1993 Elkin et al.
5,362,776 A 11/1994 Barenberg et al.
5,439,730 A 8/1995 Kelly et al.
5,947,282 A 9/1999 Merrill et al.
2005/0287367 A1 12/2005 Lai

FOREIGN PATENT DOCUMENTS

DE 102 28 406 A1 1/2003
EP 0 346 289 A2 12/1989
EP 1 785 072 A1 5/2007

OTHER PUBLICATIONS

Search Report for corresponding PCT International Application No. PCT/IB2008/003216, dated Feb. 18, 2009.

* cited by examiner

*Primary Examiner*—Alexander Thomas
(74) *Attorney, Agent, or Firm*—Hahn, Loeser & Parks, LLP

(57) ABSTRACT

A container insert for taking up extra space may be placed in a container intended for storage and/or shipment of material to an end user. The insert may be generally longitudinal having a helical configuration that may be expanded and constricted for taking up different volumes of space within the container respective of the amount of material stored therein. The insert may also be elastically deformable or generally pliable and may absorb impact forces for preventing or minimizing damage to the material.

29 Claims, 7 Drawing Sheets

INSERT FOR CONTAINER PACKAGING

CROSS-REFERENCE TO RELATED APPLICATIONS/INCORPORATION BY REFERENCE

This application is a divisional patent application claiming priority to U.S. utility patent application Ser. No. 11/967,669 filed on Dec. 31, 2007, which is incorporated herein by reference in its entirety.

TECHNICAL FIELD

The present invention pertains to methods and devices for packing materials in a container, and more particularly, methods and devices for tightly packing rod-like material in a canister.

BACKGROUND OF THE INVENTION

Countless products are packaged and shipped to end-users in this country and around the globe every day. Many products are placed in crates or boxes and filled with packing material to minimize or prevent damage during shipping. In some circumstances, products are wrapped with layers of plastic material encapsulated with air, known commonly as bubble wrap, which helps protect the product from shock or impact. Other containers all filled with packing materials made from polymers expanded into foam through the use of heat, typically in the form of steam. Polystyrene is an example of one such type of polymer. These air filled "peanuts" also function to protect the packaged products by absorbing force thereby minimizing damage to the surrounding article.

Some products are stored and packaged in canisters, which may be sealed to prevent the enclosed items from exposure to ambient conditions. Some canisters are hermetically sealed to prevent exposure to air and/or humidity, which may oxidize or otherwise damage the contents. Such containers help preserve the freshness of the packaged items. Examples of packaged products range from edible substances to industrial consumables. In many cases, the same or similarly sized canisters are used to package different quantities of materials. For a particular quantity of product, extra space remaining in the canister may allow the product to jostle about during shipment providing opportunity for individual articles to collide with each other and the walls of the canister thereby increasing the likelihood of damage.

One particular example of packaged articles relates to welding consumables, and more specifically welding electrodes. Stick welding is a common welding process. The process utilizes a finite length welding rod that is consumed by establishing an arc between the electrode and the work piece. The electrodes function best when stored in air tight containers. Usually, one size of container stores a variety of welding rod types where differences in density translate into one welding rod that is more loosely or tightly packed than another. Extra space within the container often causes damage to the welding rods as its coating is prone to fracture when the welding rods collide with each other during shipment.

It would be useful to incorporate a packing insert that takes up the volume of extra space in the container without regard to how much material is stored inside. However, packing material, such as that mentioned above, is not practical for use in these types of application. It is a laborious process to insert bubble wrap, particularly into a canister, without damaging or puncturing the inflated cells. Moreover, when deflated, the cells of the bubble wrap are rendered useless in filling up the excess space. Foamed polymers are subject to the same result. Moreover, this type of packing material tends to crumble and cling to the contents of the canister requiring the user to clean off debris with each rod removed.

What is needed is a packing insert that automatically adjusts to the amount of product stored in a container. The packing insert should be easy to apply and should minimize the damage of the container articles due to jostling. The embodiments of the subject invention obviate aforementioned problems.

BRIEF SUMMARY

In one embodiment of the subject invention a container insert used in packaging one or more associated articles in an associated container having at least a first wall includes an insert body being operable to substantially tightly pack associated material with respect to the at least a first wall of the associated container, wherein the insert body is capable of expanding and contracting responsive to the amount of associated material placed into the associated container.

In one aspect of the embodiments of the subject invention, the insert body is resiliently deformable for storing elastic energy used to tightly pack the associated material.

In another aspect of the embodiments of the subject invention, at least a first portion of the insert body is coiled for storing elastic energy.

In yet another aspect of the embodiments of the subject invention, the insert body is generally longitudinal having a longitudinal axis, wherein the insert body is helically configured substantially along the entire length of the longitudinal axis.

In even another aspect of the embodiments of the subject invention, the insert body is unitary and contiguously formed and may be constructed from a polymer material such as polypropylene.

In yet another aspect of the embodiments of the subject invention, the insert body does not encapsulate fluid substances. Fluid substances may refer to either liquid or gaseous substances. By encapsulating it is meant that the insert body does not form an enclosed shell or housing that isolates fluid substances within an interior region of the insert body with respect to an exterior region of the insert body. Rather, the insert body may include a generally open center portion.

In another embodiment of the subject invention a system for packaging associated material includes a container having one or more wall members for containing the associated material, and means for packing the associated material in the container, wherein said means for packing stores elastic energy to substantially tightly pack the associated material with respect to the one or more wall members.

In one aspect of the embodiments of the subject invention, said means for packing automatically expands and contracts responsive to the amount of associated material stored in the container.

In yet another aspect of the embodiments of the subject invention, said means comprises at least a first portion of elastically deformable material, wherein the at least a first portion of elastically deformable material comprises a band of contiguously formed thermoplastic material.

In still another aspect of the embodiments of the subject invention, said means comprises a coil of material spirally configured with respect to a central axis.

In even another aspect of the embodiments of the subject invention, the container may be hermetically sealed or sealed with a removable cap.

In another embodiment of the subject invention, a method for tightly packing welding rod into a canister comprising the steps of providing an canister having one or more walls, placing an amount of welding rod into the canister, and inserting a resiliently deformable container insert into the canister, wherein the container insert is operable to automatically expand and contract responsive to the amount of associated material stored in the canister.

In one aspect of the embodiments of the subject invention, the resiliently deformable container insert comprises a coil of contiguously formed material, and further includes the step of substantially tightly winding the coil of contiguously formed material around an insertion member.

DETAILED DESCRIPTION OF THE INVENTION

Figure 1:
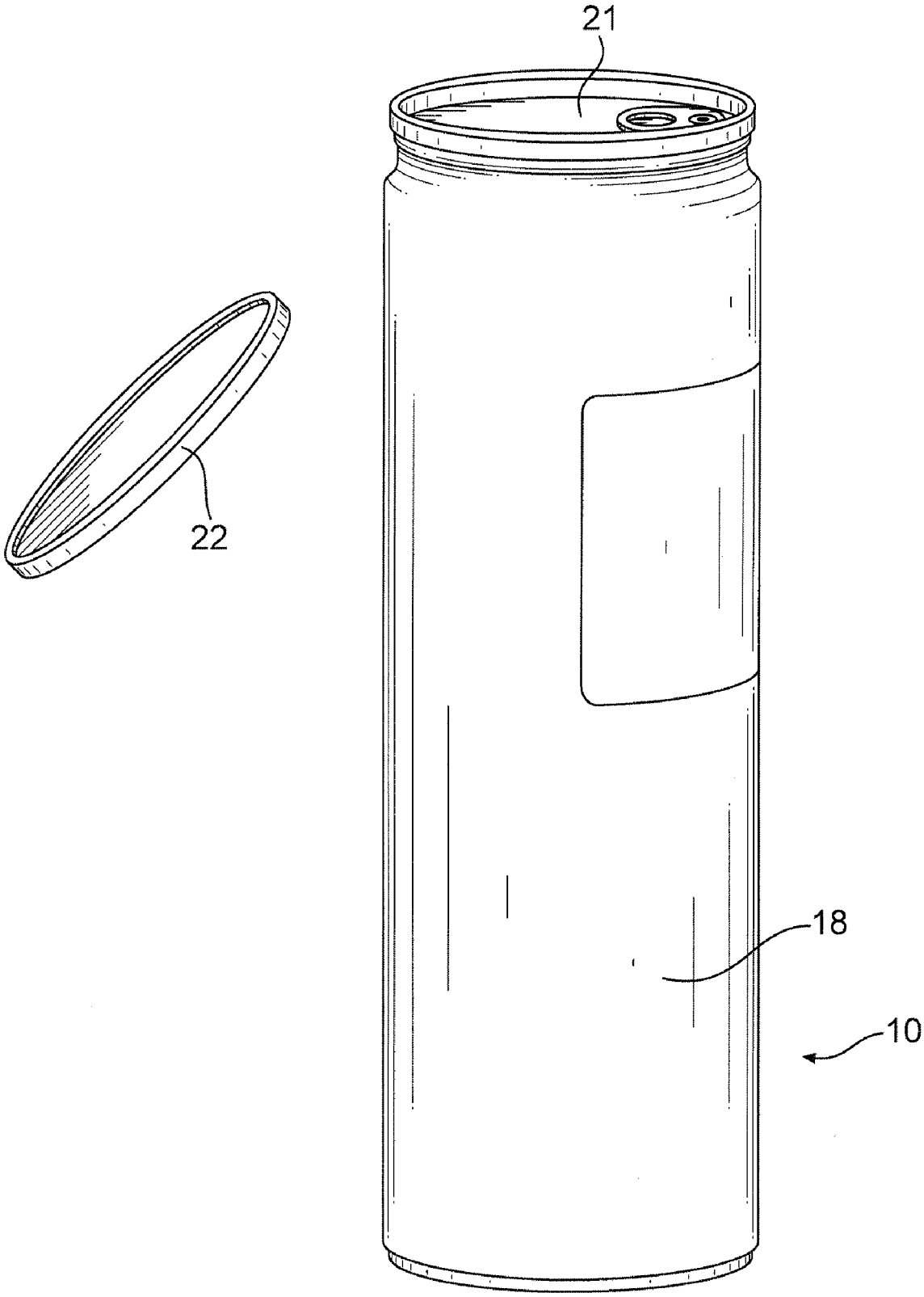
FIG. 1 is a perspective view of a container for storing and/or transporting articles according to the embodiments of the invention.

Referring now to the drawings wherein the showings are for purposes of illustrating embodiments of the invention only and not for purposes of limiting the same, FIG. 1 shows a container for holding various articles, depicted generally at 10. The container 10 may be used to package a plurality of articles 14, shown in FIG. 2, for storage and/or transportation purposes. As such, the container 10 may be generally rigid. In one embodiment, the container 10 may be a cylindrical receptacle constructed from metal or metal alloy. Other embodiments contemplate a boxlike container 10. This type of container 10 may be constructed from rigid or semi rigid material. However, persons of ordinary skill in the art will readily understand the application of the embodiments of the subject invention to any size, shape and/or material used to construct the container 10. By way of example, the figures depict a generally cylindrical canister 18. The canister 18 may be used to hold rod-like articles, such as for example, welding rods 15. However, the type of articles 14 contained by the canister 18 are not to be construed as being limited to welding materials or even rod shaped articles. Rather any type of article 14 may be stored in the canister 18 as is appropriate for use with the embodiments of the subject invention. In the current embodiment, the canister 18 may be hermetically sealed with a pop-open tabbed cap or seal 21. Sealing the canister 18 in this manner helps to preserve the articles 14 stored within the canister 18 from exposure to ambient conditions. A reclosable cap 22 may also be provided for subsequently sealing the contents of the canister 18 after the seal 21 has been removed.

Figure 2:
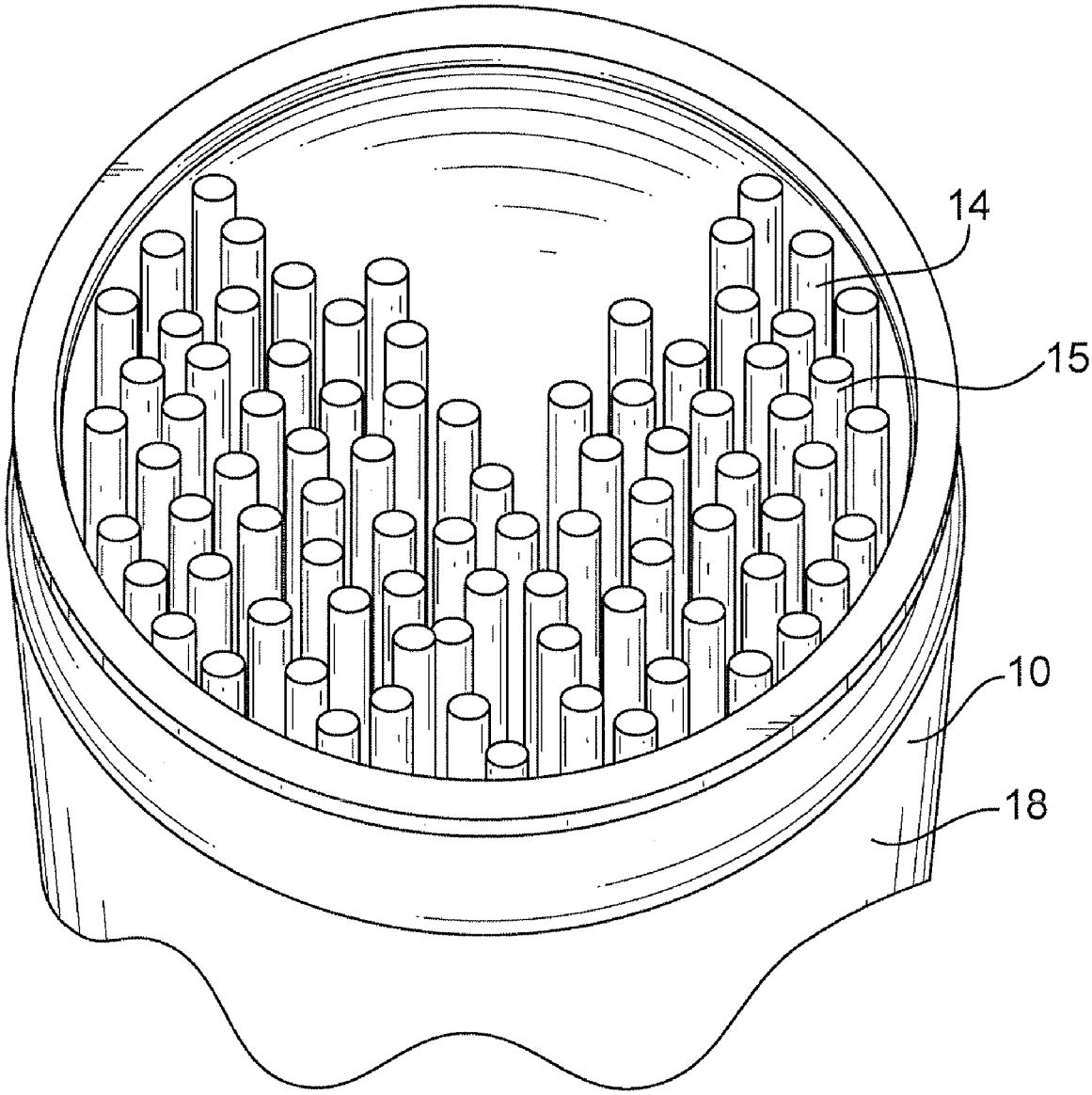
FIG. 2 is a close up perspective view of an open container storing one or more articles according to the embodiments of the invention.

FIG. 2 depicts a plurality of rod-like articles 14 stored within the container 10. In certain applications, the container 10 may be utilized to store a particular amount of material, which may be measured in terms of weight. For example, ten (10) pounds of a particular type of welding rod 15 may be designated for storage in the container 10. It will be readily understood that one type of welding rod 15 may have a substantially different density than another type of welding rod. Accordingly, ten (10) pounds of a first type of welding rod 15 will result in a different quantity than a second type of welding rod. In either case, the same kind of container 10 may be used to store both types of welding rod 15. It follows that different volumes of empty space may therefore reside within the container 10 depending on the type, or density, of material stored therein. Without the use of an insert, welding rod 15 stored within the container 10 may be banged or knocked against the sides of the container 10, as well as other welding rods 15, resulting in damage to the articles. Accordingly, a container insert 27, shown in FIG. 3, may be installed to effectively take up the volume of empty space within the container 10. It is noted that the container insert 27 may fill up the empty space within the container 10 irrespective of the quantity or type of material being stored in the container 10, as will be discussed in the following paragraphs.

Figure 3:
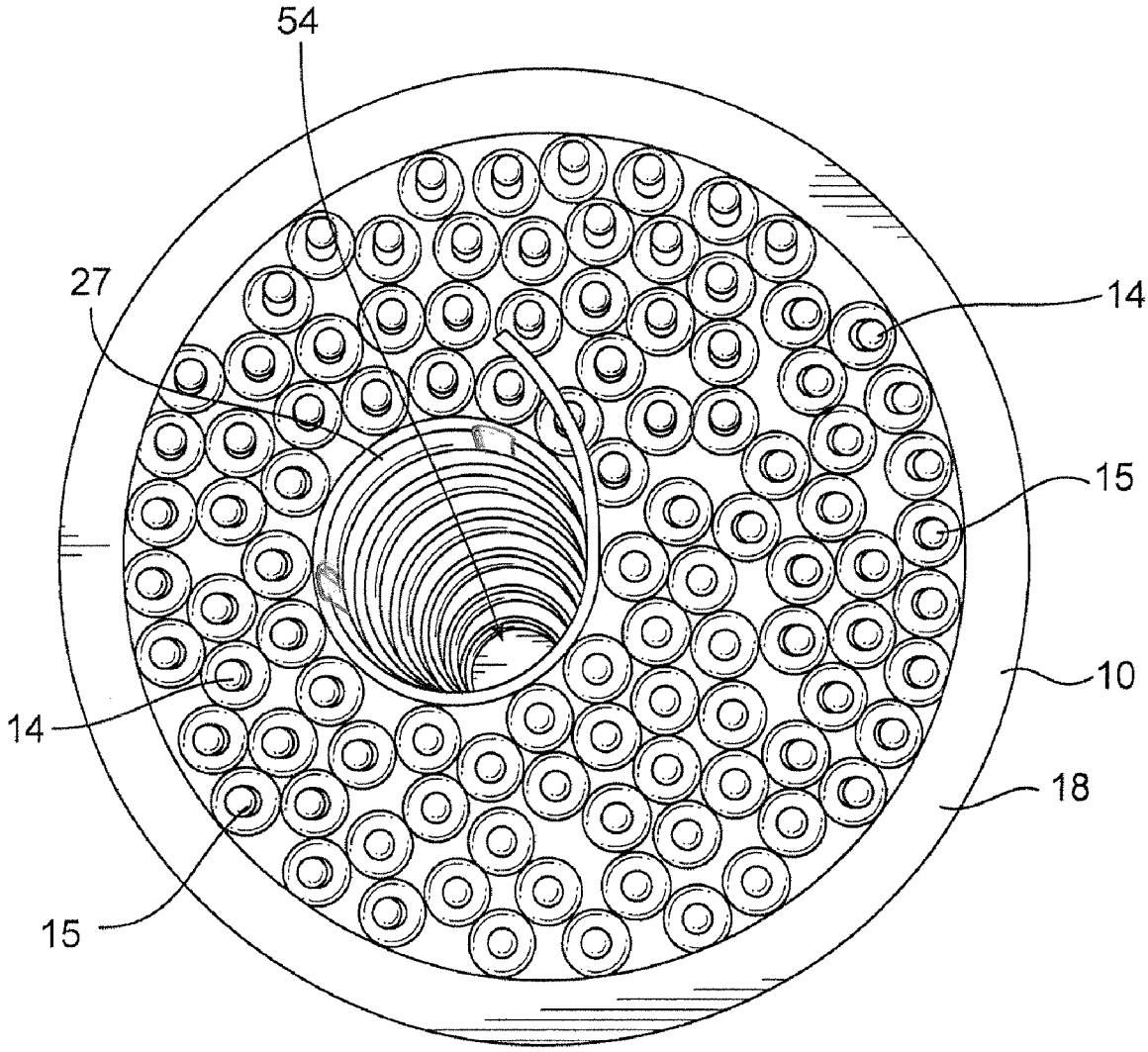
FIG. 3 is a close up perspective view of an open container storing one or more articles and an insert for taking up additional space within the container according to the embodiments of the invention.

With reference now to FIG. 3, a plurality of articles 14 are shown packed into the canister 18. It is noted that the articles 14, which may be welding rod 15 or any other articles suitable for storage in the canister 18, are tightly packed with respect to the sides of the canister 18 and with respect to the other articles 14. A container insert 27 is also shown inserted between the plurality of articles 14. The container insert 27 may function to take up space in the canister 18 not filled by the articles 14 resulting in little or no gaps disposed between the welding rods 15. In one embodiment, the container insert 27 may be capable of automatically expanding or contracting for taking up different volumes of space. In the case of fewer articles 14, the insert 27 may expand its circumference, thereby filling up a greater volume of space. Conversely, for a greater number of articles 14, the container insert 27 may contract as constrained by the articles 14 and/or the sides of the container 10. In this manner, the container insert 27 may automatically conform to the volume of space in the canister 18 not taken up by the articles 14. It will be appreciated that a tightly packed canister 18 will minimize the detrimental effects of the articles 14 bumping or knocking into each other and the side walls of the canister 18 during transportation or shipment. In the exemplary case of welding rod 15, the impact of one welding rod 15 with that of another may cause the coating on the welding rod 15 to break loose rendering the rod unusable for welding. The container insert 27 may also absorb shock as may be experienced during transportation or shipment. Accordingly, the insert 27 may be a generally pliable insert 27 being elastically deformable, i.e. able to retain its original shape after being subjected to force as will be discussed further below.

Figure 4:
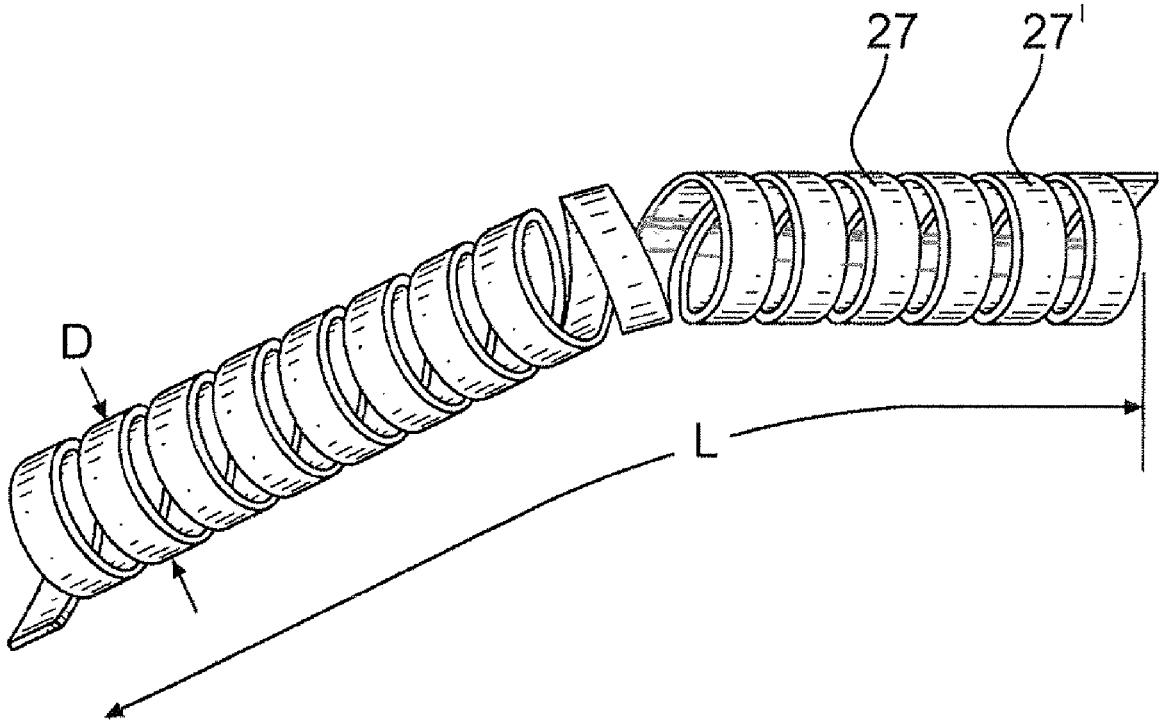
FIG. 4 is a close up perspective view showing one embodiment of a container insert according to the embodiments of the invention.

With reference to FIGS. 3 and 4, the container insert 27 may function to store potential energy for tightly packing the articles 14 in the container 10. The potential energy may be in the form elastic energy, as mentioned above. The amount of elastic energy stored in the container insert 27 may be a function of the configuration of the container insert 27. In one embodiment, the container insert 10 may be helical. Other embodiments include adjacently formed elastic fingers joined to a common spine. However, it is to be construed that the container insert 10 may have any configuration as is appropriate for storing potential energy used to tightly pack the articles 14 into the container 10. Potential elastic energy may also be a function of the type of material from which the container insert 27 is made. Materials having stronger molecular bonds may possess greater potential for storing elastic energy. All such material types and configurations are to be construed as being included within the scope of coverage of the embodiments of the subject invention.

With continued reference to FIG. 4, the container insert 27 may be a contiguously formed unitary device. In one embodiment, the container insert 27 may have a circular cross section possessing a characteristic diameter. The container insert 27 may also be generally longitudinal having a length corresponding to the height of the container 10. Accordingly, the container insert 27 may be substantially the same height as the container 10. Alternatively, the container insert 27 may be shorter than the height of the container 10 into which it is being inserted. In this manner, as the length of the container insert 27 expands, it will not extend beyond the ends of the container 10. However, any longitudinal dimension of the container insert 27 may be chosen with sound engineering judgment. The container insert 27 may be constructed from a polymer material such as a thermoplastic. Polypropylene is one exemplary type of thermoplastic material that may be used to construct the container insert 27 having elastic properties suitable for use with the embodiments described herein. Still, the container insert 27 may be constructed from any type of material as is appropriate for use with the embodiments of the subject invention including but not limited to polymers, fibrous materials, metals, alloys and the like.

With reference again to FIG. 4, the container insert 27 may be constructed having a generally curved configuration, which may be a helical configuration thereby termed a helix or helical insert 27'. In this example, the material of the helix 27' may be fashioned into a spiral, contiguously formed progressively along a longitudinal axis. The helix 27' may function to resist being deformed or constricted by the contents of the container 10 and as a result pushes against the container's contents thereby tightly packing the articles 14 therein. It will be readily seen that the container insert 27 is flexible and generally capable of expanding and contracting radially, as well as longitudinally. In a first unrestricted state, the container insert 27 may have a characteristic diameter D and a characteristic length L as determined by the configuration of the container insert 27 when initially formed. The spirals of the container insert 27 therefore define a volumetric region derived from the diameter D and the length L. It is noted that the first unrestricted state may comprise a maximum of the range of volumes that container insert 27 may fill. In a second constricted state, the spirals of material may be wound more tightly thereby defining a smaller volumetric region. It will be appreciated that the second constricted state may be infinitely variable between the maximum and a minimum diameter, of which the minimum diameter may relate to the thickness of the material used to construct the container insert 27. Persons of ordinary skill in the art will understand that the spring-like properties of the material comprising the container insert 27 will allow its configuration to automatically adjust responsive to the amount of material stored in the container 10.

Figure 5:
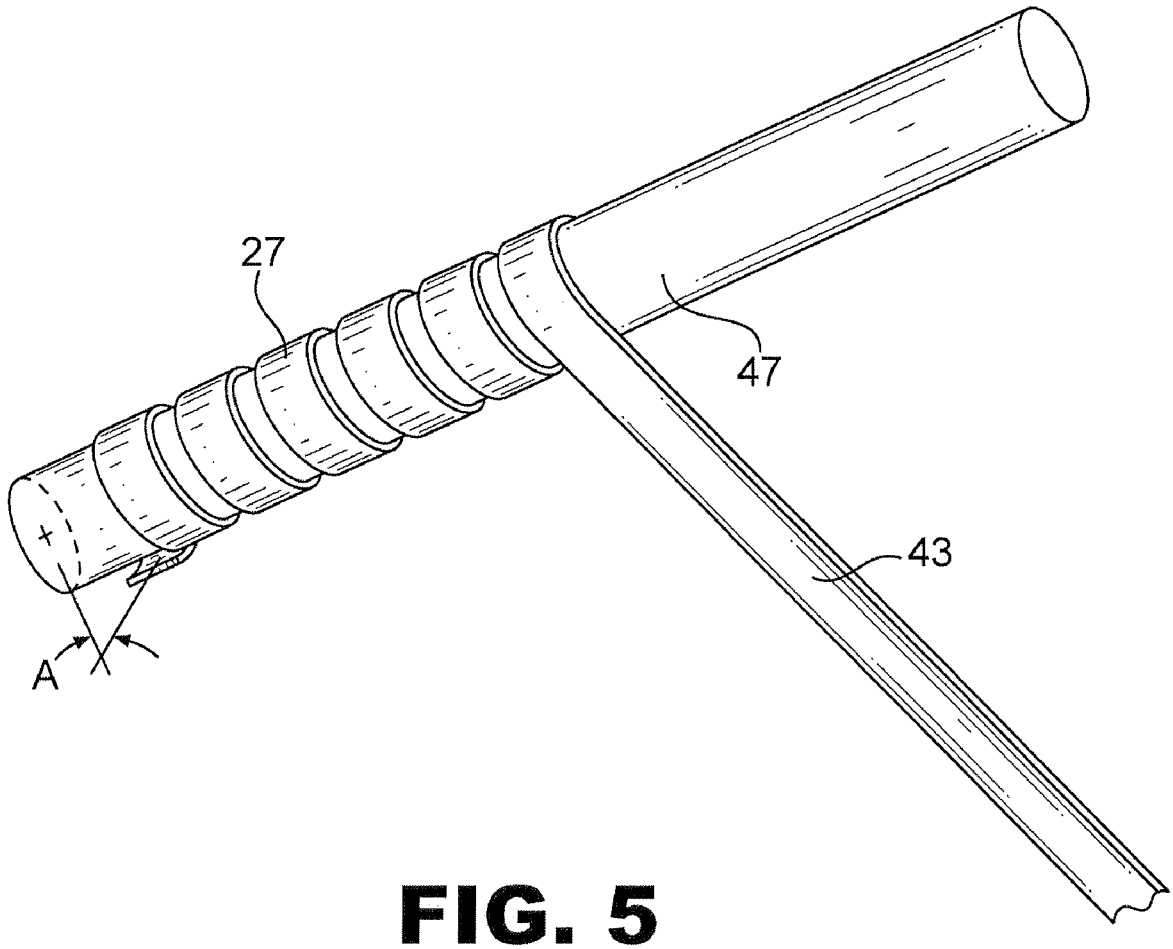
FIG. 5 is a perspective view of a container insert being wound on a core according to the embodiments of the subject invention.

With reference now to FIGS. 4 and 5, in one embodiment, the container insert 27 may be constructed from a contiguously formed strip of material 43. As previously mentioned, the strip of material 43 may be comprised of a polymer material such as may be extruded in a process well known in the art. The strip of material 43 may be generally flat having a rectangular cross section. However, other cross sectional configurations of material may also be utilized including but not limited to: circular, oval, or square. In fact any configuration of material may be used to construct the container insert 27 as is appropriate for use with the embodiments of the subject invention. The strip of material 43 may be wound onto a core 47 at an acute angle A thereby allowing the material 43 to wrap around the core in a coiled fashion. It is noted that the strip of material 43 may be wound at any angle without departing from the intended scope of coverage of the embodiments of the subject invention. Additionally, any diameter or cross section of the core 47 may be used to fashion the container insert 27 thereby determining the container insert's 27 potential to store elastic energy and its capability to tightly pack the articles 14 in the container 10. In this way, the container insert 27 may automatically expand and contract in the spring-like manner described above. During installation, the container insert 27 may be wound tightly with respect to a centerline axis, inserted into the container can and subsequently allowed to automatically expand thereby packing the articles tightly in the container 10. It is noted here that other processes may be utilized to construct the container insert 10 including injection molding. However, any process may be used without limiting the scope of coverage of the embodiments of the subject invention.

Figure 6:
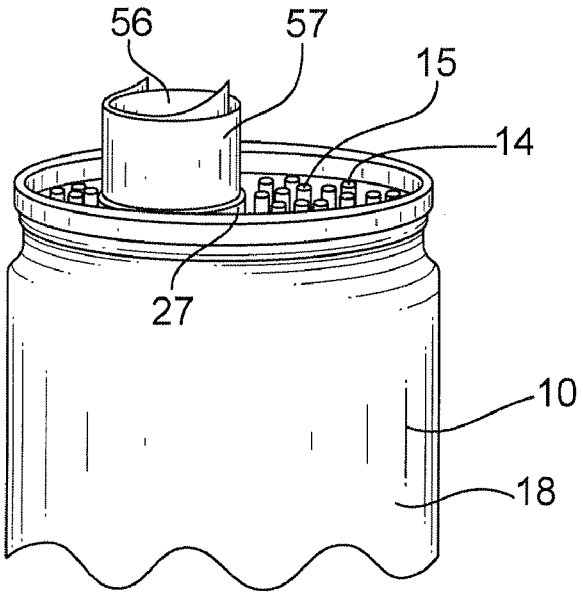
FIG. 6 is a perspective view of a container having a container insert and an accessory placed within an interior region of the container insert.

With reference again to FIG. 3 and now to FIG. 6, it will be readily seen that the interior of the container insert 27 may be generally hollow. This hollow region of space 54 may remain segregated as the container insert 27 holds the articles 14 or welding rods 15 tightly against the sides of the container 10. In one embodiment, it is contemplated that the generally hollow region 54, shown in FIG. 3, inside may be used to store one or more items or accessories 57 associated with the articles 14 placed in the container 10. Operating instructions 56, which may be a pamphlet, are one example of a type of accessory 57 that may be placed into the hollow region 54 with the articles 14 for storage and/or transportation to the end user. A MSDS (Material Safety Data Sheet) is another example of an item, or accessory 57, that may be placed in the hollow region 54. The items may comprise verbiage printed on generally light and flexible paper. As such, an accessory 57 of this type will not affect the function of the container insert 27 nor will it detrimentally impact the container's contents. It is expressly noted here that accessories 57 of this type are exemplary in nature and are not to be construed as limiting. Rather any type of accessory 57 may be placed into the hollow region 54 that will not detrimentally effect the function of the container insert 27 or the condition of the articles 14.

Figure 8:
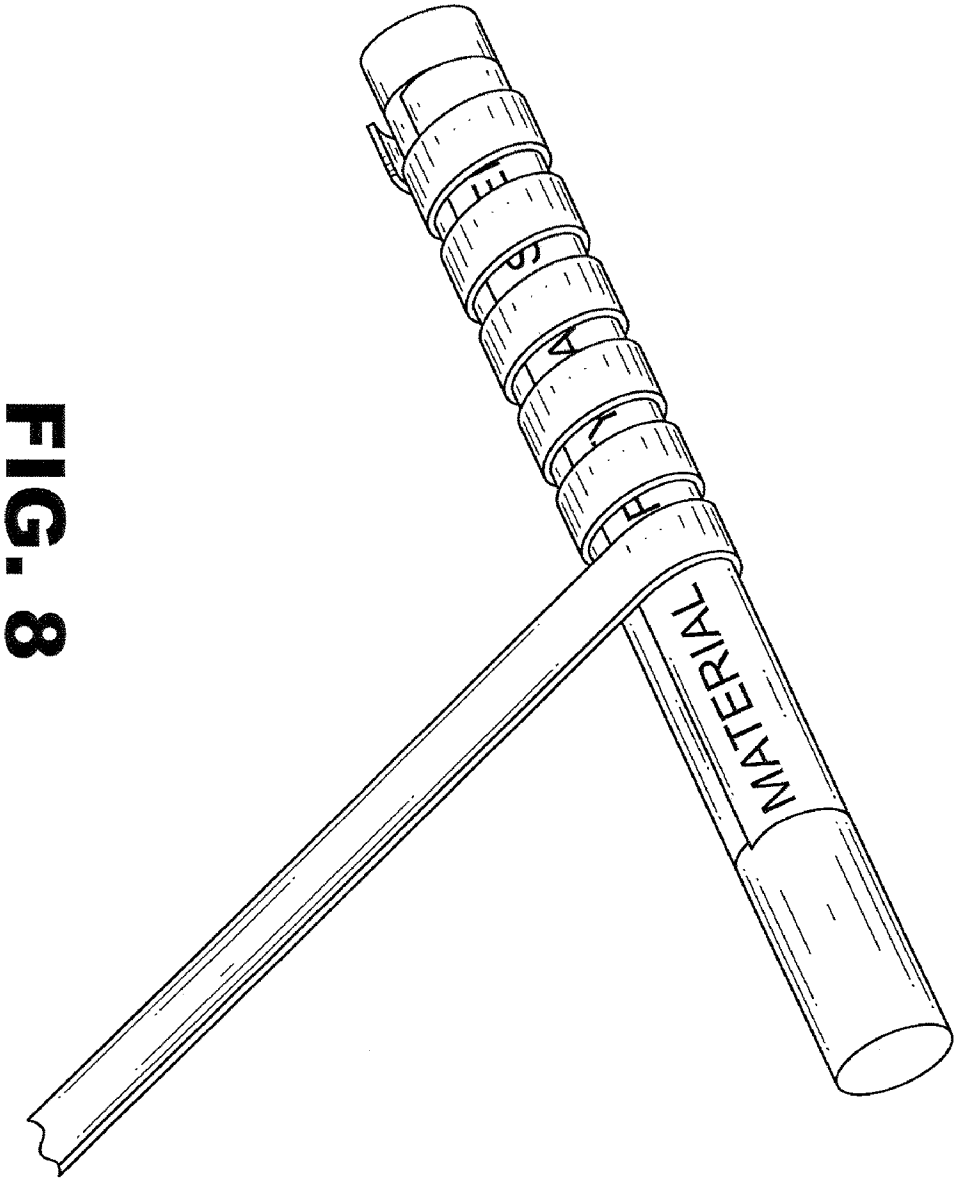
FIG. 8 is a perspective view of an accessory and a container insert being wound on a core according to the embodiments of the subject invention.

With reference now to FIG. 8, as mentioned above it may be necessary or desirable to provide information to the end user regarding the contents of the container 10. Such information, like for example safety data, may be presented to the end user directly upon opening the container 10. Typically, safety data is printed on paper that can be placed within the hollow region 54 as described above. It certain circumstances, it may be necessary to ensure that the information presented is clearly seen by the end user and free from obscurity. Accordingly, an accessory 57, which in the current example is a Material Safety Data Sheet, may be placed within the container 10 and positioned proximate to the container opening for presentation to the end user when the container 10 is opened. The accessory 57 may be inhibited from moving within the container 10 by one or more means to make certain that the end user sees the item. In one embodiment, the accessory 57 may be affixed to the container insert 27 near the opening of the container 10. Clips or hooks may be utilized to hold the accessory 57 firmly in place such that when the container insert 27 is removed from the container 10, the accessory 57 is removed at the same time. This presents the accessory 57 to the end user prior to removing and using the container contents. It is contemplated that the container insert 27 may be constructed having recesses or notches contoured to receive the accessory 57 and/or the fasteners. However, any manner and/or configuration of forming the container insert 27 to receive an accessory 57 may be chosen with sound engineering judgment.

In another embodiment, an adhesive may be used to adhere the accessory 57 to the container insert 27. The adhesive may be a tacky re-adherable substance such as that developed by the 3M Corporation. Alternatively, the adhesive may comprise fast-holding glue or tape. However, it is to be construed that any type or form of adhesive may be utilized as is appropriate for use with the embodiments of the subject invention. The adhesive may be applied to the container insert 27 and/or the container 10. More specifically, the adhesive may be applied to one or more of the container insert surfaces where after the accessory 57 may be adhered to the container insert 27. In one embodiment, the adhesive may be applied to the container insert 27 prior to fashioning or coiling the container insert 27. In this case, the accessory 57 may first be wrapped around the core 47 and the container insert 27 subsequently formed around the core 47 in a manner consistent with the embodiments described herein. It will be appreciated that re-adherable adhesive will allow the end user to easily remove the accessory 57 without damage. Alternatively, the accessory 57 may be adjoined to the container insert 27 after the container insert 27 has been formed or coiled. Still, any manner of attaching the accessory 57 to the container insert 27 may be chosen without limiting the intended scope of coverage of the embodiments of the present invention. In this way, the accessory 57 is held in unobstructed view by the end user until removed from the container 10. This ensures that the end user is presented with the Material Safety Data Sheet or other accessory 57 at the time of opening the container 10.

The accessory 57 may be affixed or adhered to something other than or in addition to the container insert 27, like for example the sides of the container 10 or the container lid. In this embodiment, the accessory 57 may be attached to the tabbed cap or seal 21 using an adhesive, or other means. When the end user opens the container 10 by pulling on the cap 21, the adhesive applied between the accessory 57 and the cap 21 pulls the accessory 57 from within the hollow region 54 and immediately presents the accessory 57, e.g. the Material Safety Data Sheet, to the end user. It is noted that any type or manner of applying adhesive substances between the accessory 57, container insert 27 and/or the cap 21 may be chosen as is appropriate for use with the embodiments of the subject invention.

Figure 7:
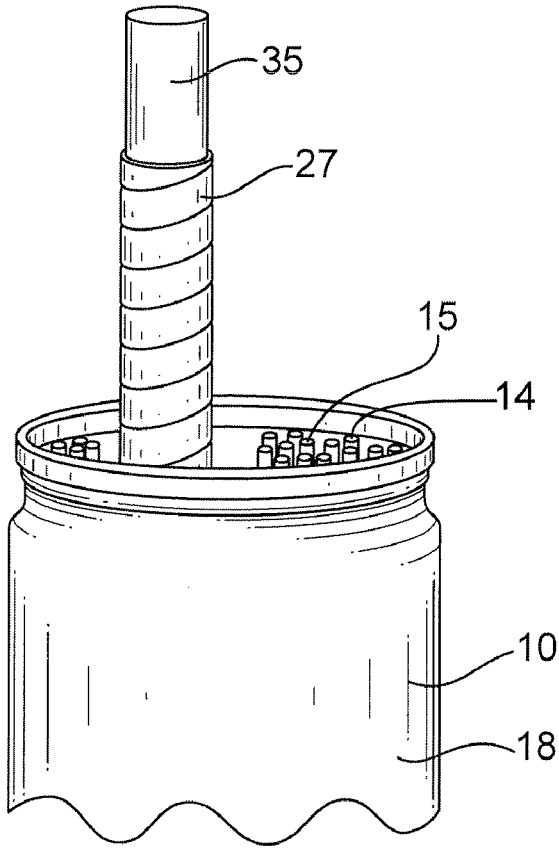
FIG. 7 is a perspective view showing the container insert being inserted into a container.

With reference now to all of the figures but especially to FIG. 7, operation of the container insert 27 will now be described. The container 10 may be filled with a designated number of articles 14. The number of articles 14 may accumulatively take up a percentage of the volume as defined by the side walls and ends of the container 10 leaving free space between the articles 14. A container insert 27 may then be tightly wound onto an insertion member 35 having a diameter sufficiently small enough to fit within the volume of free space in the container 10. While holding the container insert 27 tightly against the insertion member 35, the operator may push both items, i.e. the container insert 27 and the insertion member 35, in between the articles 14 stored in the container 10. Subsequently releasing the container insert 27 will cause the helix 27' or fingers 25 to expand against the sides of the articles 14 and/or the walls of the container 10 thereby tightly packing the articles 14 within the container 10. Accessories 57 may then be subsequently placed into the hollow region 54 of the container insert 27. The container 10 may then be closed or sealed for storage and/or transportation as desired. As the container 10 is banged or jolted during transportation movement of the articles 14 back and forth will be minimized by the container insert 27. Additionally, shock or impact forces translated into the container 10 may be absorbed by the elastic deformation and constriction of the container insert 27. After the inertia has dissipated, the elasticity of the container insert 27 will expand its circumference thereby taking up the free space within the container 10.

The invention has been described herein with reference to the preferred embodiment. Obviously, modifications and alterations will occur to others upon a reading and understanding of this specification. It is intended to include all such modifications and alternations insofar as they come within the scope of the appended claims or the equivalence thereof.

What is claimed is:

1. A system for packaging associated material, comprising:
associated material including at least one welding rod,
a container having one or more wall members containing the associated material; and,
means for packing the associated material in the container, wherein said means for packing is coiled storing elastic energy and substantially tightly packing the associated material with respect to the one or more wall members.

2. The system as defined in claim 1, wherein said means for packing automatically expands and contracts responsive to the amount of associated material stored in the container.

3. The system as defined in claim 1, wherein said means comprises at least a first portion of elastically deformable material.

4. The system as defined in claim 3, wherein the at least a first portion of elastically deformable material comprises a band of contiguously formed thermoplastic material.

5. The system as defined in claim 1, wherein said means comprises a coil of material spirally configured with respect to a central axis.

6. The system as defined in claim 1, wherein the container is hermetically sealed.

7. The system as defined in claim 1, wherein the container is a cylindrical receptacle.

8. The system as defined in claim 7, wherein said means for packing has a helical configuration having a longitudinal axis substantially parallel to a longitudinal axis of the container.

9. The system as defined in claim 1, wherein said means for packing has a helical configuration having a longitudinal axis substantially parallel to a longitudinal axis of the container.

10. A system for packaging associated material, comprising:
associated material,
a container having one or more wall members containing the associated material; and,
means for packing the associated material in the container, wherein said means for packing expands radially and is coiled storing elastic energy and radially substantially tightly packing the associated material with respect to the one or more wall members, wherein the associated material is radially disposed between said means for packing and the one or more wall members.

11. The system as defined in claim 10, wherein said means for packing automatically expands and contracts responsive to the amount of associated material stored in the container.

12. The system as defined in claim 10, wherein said means comprises at least a first portion of elastically deformable material.

13. The system as defined in claim 12, wherein the at least a first portion of elastically deformable material comprises a band of contiguously formed thermoplastic material.

14. The system as defined in claim 10, wherein said means comprises a coil of material spirally configured with respect to a central axis.

15. The system as defined in claim 10, wherein the container is hermetically sealed.

16. The system as defined in claim 10, wherein the associated material includes at least one rod shaped article.

17. The system as defined in claim 10, wherein the container is a cylindrical receptacle.

18. The system as defined in claim 17, wherein said means for packing has a helical configuration having a longitudinal axis substantially parallel to a longitudinal axis of the container.

19. The system as defined in claim 10, wherein said means for packing has a helical configuration having a longitudinal axis substantially parallel to a longitudinal axis of the container.

20. A system for packaging associated material, comprising:

associated material, a container having one or more wall members containing the associated material;

means for packing the associated material in the container, wherein said means for packing is coiled storing elastic energy and substantially tightly packing the associated material with respect to the one or more wall members, and an informational paper within said means for packing.

21. The system as defined in claim 20, wherein said means for packing automatically expands and contracts responsive to the amount of associated material stored in the container.

22. The system as defined in claim 20, wherein said means comprises at least a first portion of elastically deformable material.

23. The system as defined in claim 22, wherein the at least a first portion of elastically deformable material comprises a band of contiguously formed thermoplastic material.

24. The system as defined in claim 20, wherein said means comprises a coil of material spirally configured with respect to a central axis.

25. The system as defined in claim 20, wherein the container is hermetically sealed.

26. The system as defined in claim 20, wherein the associated material includes at least one rod shaped article.

27. The system as defined in claim 20, wherein the container is a cylindrical receptacle.

28. The system as defined in claim 27, wherein said means for packing has a helical configuration having a longitudinal axis substantially parallel to a longitudinal axis of the container.

29. The system as defined in claim 20, wherein said means for packing has a helical configuration having a longitudinal axis substantially parallel to a longitudinal axis of the container.

* * * * *